US009114278B1

(12) United States Patent
Sigel

(10) Patent No.: US 9,114,278 B1
(45) Date of Patent: Aug. 25, 2015

(54) RECUMBANT EXERCISE ASSEMBLY

(71) Applicant: George S. Sigel, Norwood, MA (US)

(72) Inventor: George S. Sigel, Norwood, MA (US)

( * ) Notice: Subject to any disclaimer, the term of this patent is extended or adjusted under 35 U.S.C. 154(b) by 37 days.

(21) Appl. No.: 13/967,969

(22) Filed: Aug. 15, 2013

(51) Int. Cl.
*A63B 22/06* (2006.01)
*A63B 26/00* (2006.01)

(52) U.S. Cl.
CPC ..... *A63B 22/0694* (2013.01); *A63B 22/06* (2013.01); *A63B 2022/0652* (2013.01); *A63B 2210/50* (2013.01)

(58) Field of Classification Search
CPC ..... A63B 2210/00; A63B 2210/50; A63B 2210/52; A63B 2210/54; A63B 22/0694; A63B 6/00; A63B 6/02; A63B 21/1473; A47G 27/0218; A47G 27/0243; A47G 27/0293
USPC ..... 482/23, 51, 57–65, 140, 142, 910; 5/417–420
See application file for complete search history.

(56) References Cited

U.S. PATENT DOCUMENTS

| | | | | |
|---|---|---|---|---|
| 3,189,344 | A * | 6/1965 | Swarts | 482/57 |
| 3,953,026 | A * | 4/1976 | Stokely | 482/123 |
| 4,538,804 | A * | 9/1985 | Zibell | 482/57 |
| 4,717,146 | A * | 1/1988 | Nohara | 482/62 |
| 5,033,736 | A * | 7/1991 | Hirschfeld | 601/36 |
| 5,066,001 | A * | 11/1991 | Wilkinson | 482/52 |
| 6,322,485 | B1 * | 11/2001 | Marrero | 482/140 |
| 2003/0092536 | A1 * | 5/2003 | Romanelli et al. | 482/60 |
| 2005/0181917 | A1 * | 8/2005 | Dayal | 482/142 |
| 2007/0129219 | A1 * | 6/2007 | Mahlberg | 482/62 |
| 2008/0118671 | A1 * | 5/2008 | Bienkiewicz | 428/12 |

* cited by examiner

*Primary Examiner* — Stephen Crow
*Assistant Examiner* — Gregory Winter

(57) ABSTRACT

A recumbent exercise assembly allows a person to exercise while lying in bed. The assembly includes a base panel and a pedal assembly coupled to and extending upwardly from the base panel. At least one support panel is coupled to and extends from the base panel. Each support panel is configured to support a person thereon while the person pedals the pedal assembly.

9 Claims, 4 Drawing Sheets

RECUMBANT EXERCISE ASSEMBLY

This application claims benefit of the provisional application, Ser. No. 61/683,932 filed Aug. 16, 2012.

BACKGROUND OF THE DISCLOSURE

Field of the Disclosure

The disclosure relates to exercise devices and more particularly pertains to a new exercise device for allowing a person to exercise while lying in bed.

SUMMARY OF THE DISCLOSURE

An embodiment of the disclosure meets the needs presented above by generally comprising a base panel and a pedal assembly coupled to and extending upwardly from the base panel. At least one support panel is coupled to and extends from the base panel. Each support panel is configured to support a person thereon while the person pedals the pedal assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
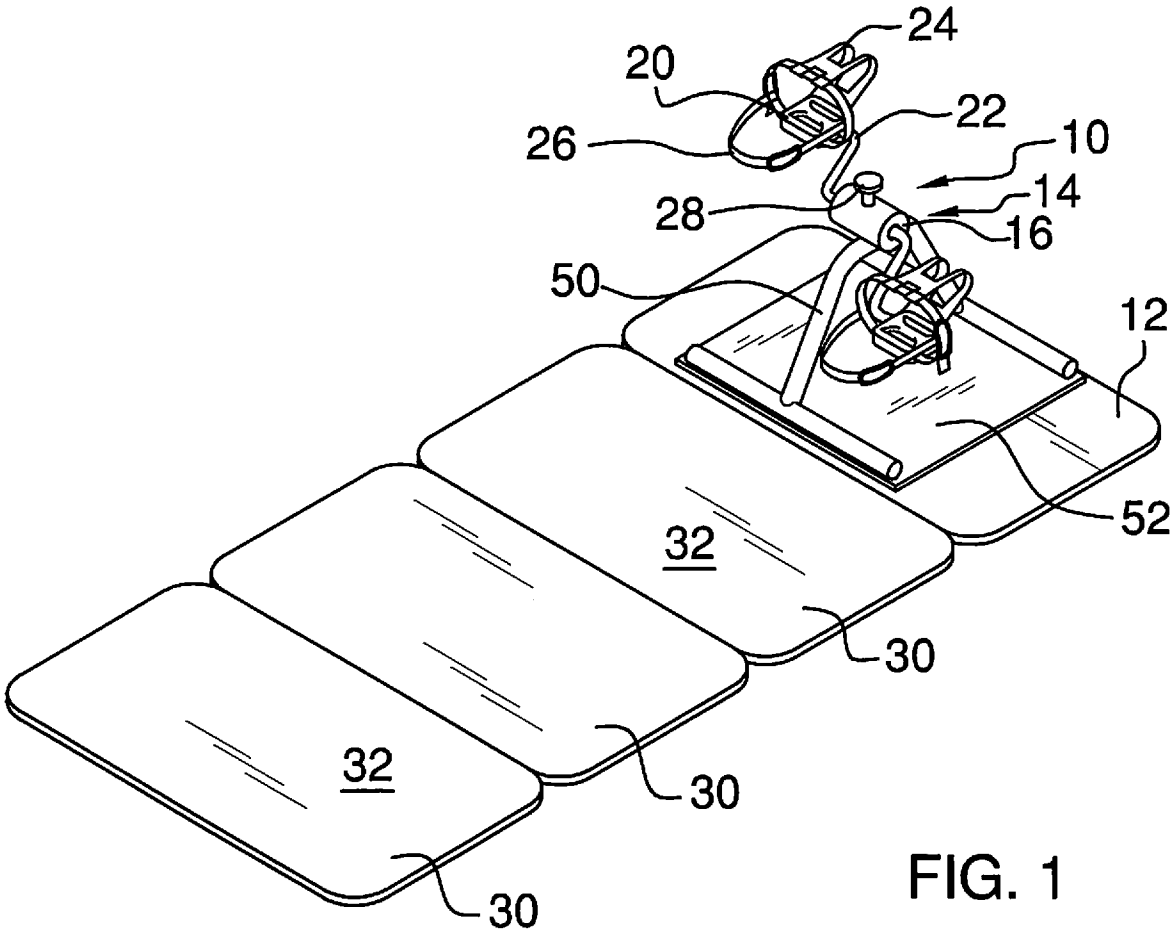
FIG. 1 is a top back side perspective view of a recumbent exercise assembly according to an embodiment of the disclosure.
Figure 2:
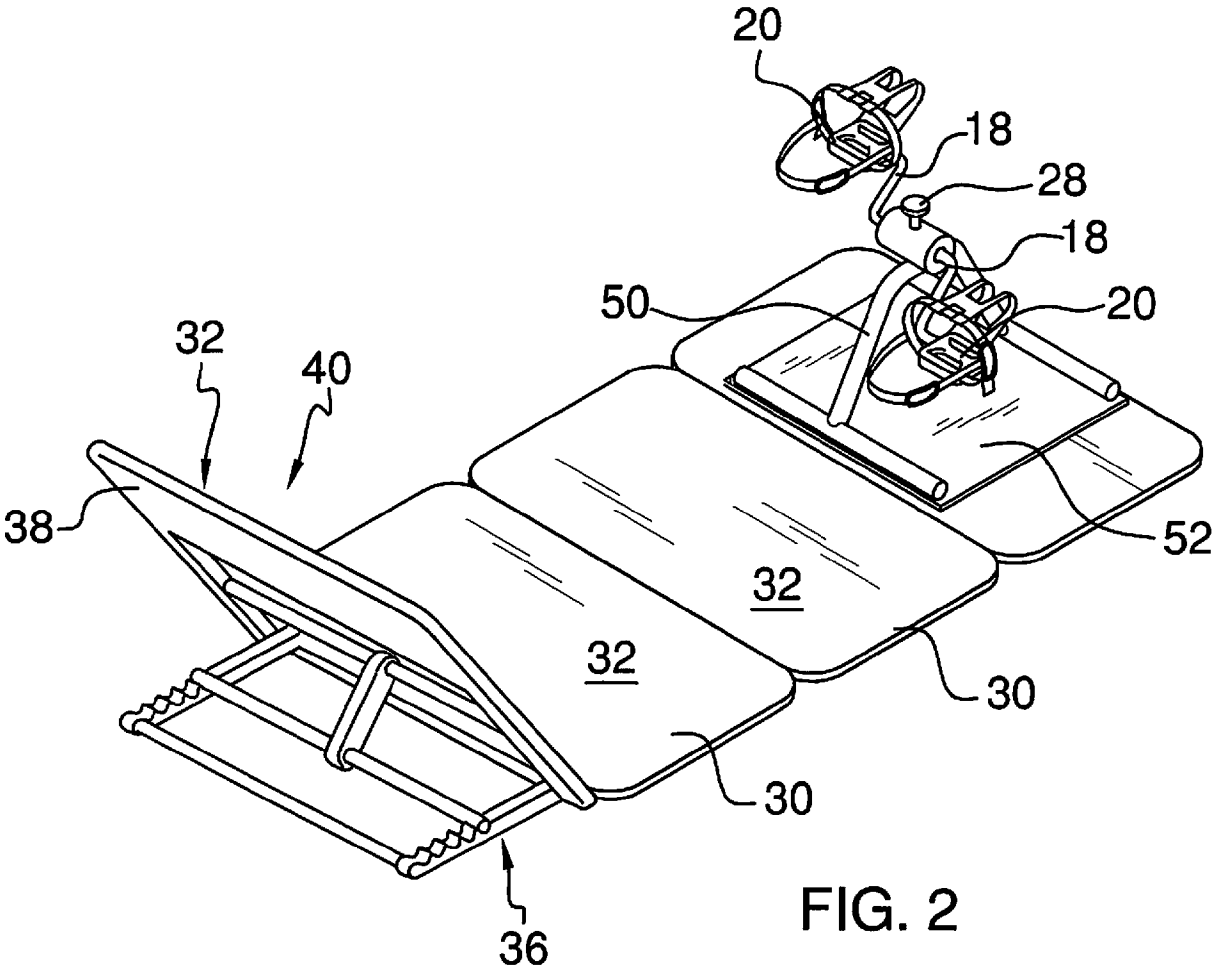
FIG. 2 is a top back side perspective view of an embodiment of the disclosure.
Figure 3:
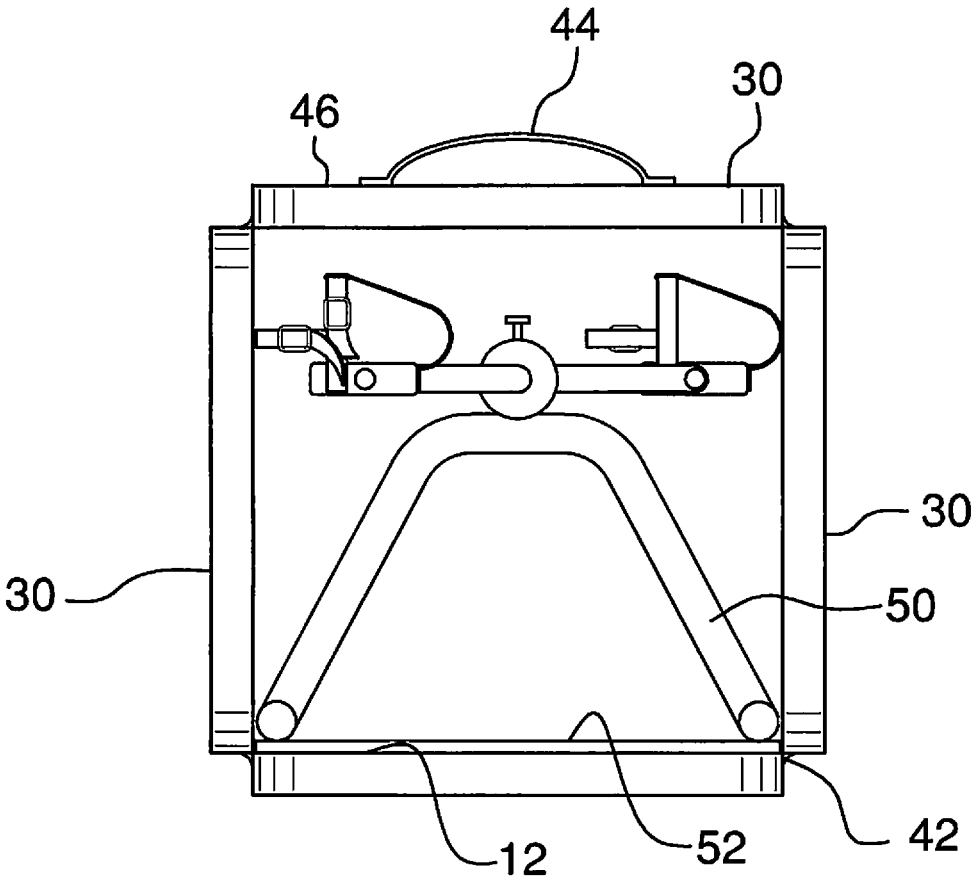
FIG. 3 is a top back side perspective view of an embodiment of the disclosure in a compacted position.
Figure 4:
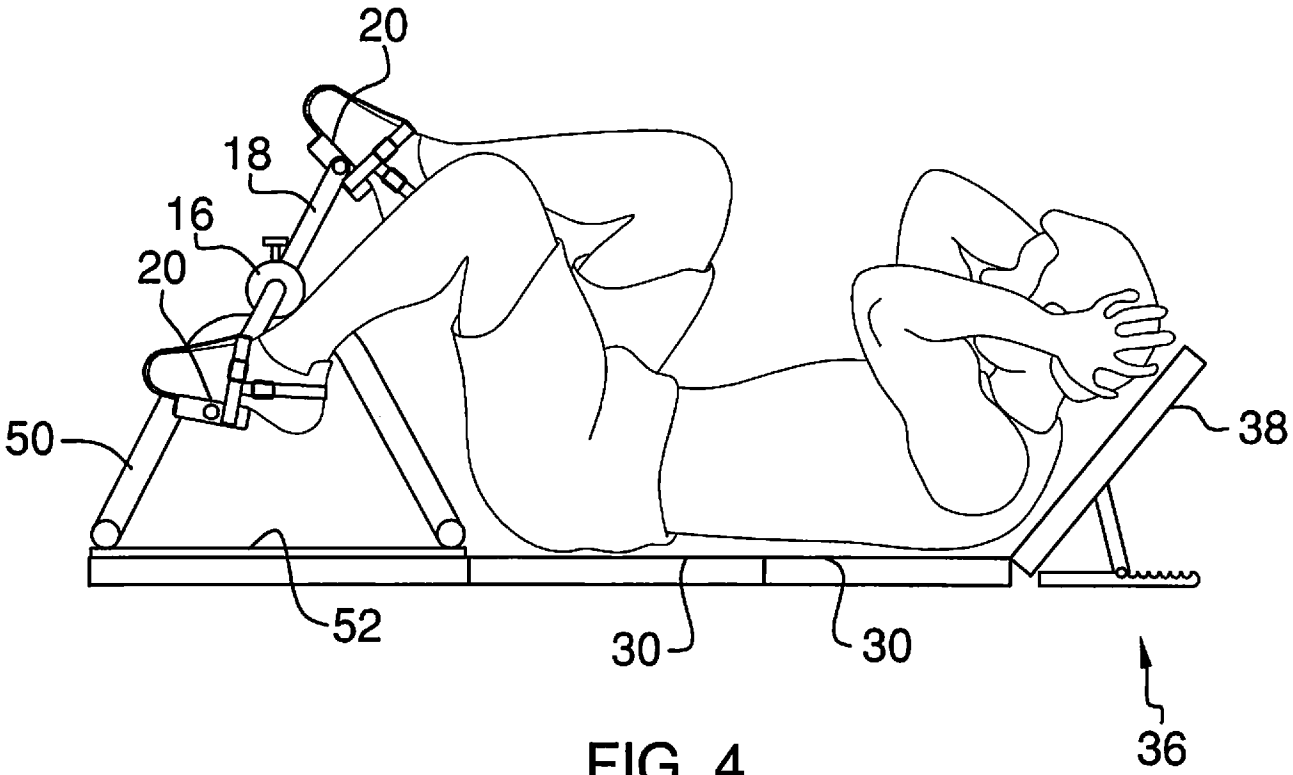
FIG. 4 is a side view of an embodiment of the disclosure in use.

With reference now to the drawings, and in particular to FIGS. 1 through 4 thereof, a new exercise device embodying the principles and concepts of an embodiment of the disclosure and generally designated by the reference numeral 10 will be described.

As best illustrated in FIGS. 1 through 4, the recumbent exercise assembly 10 generally comprises a stiff base panel 12 which may be constructed of wood or plastic. A pedal assembly 14 is coupled to and extends upwardly from the base panel 12. The pedal assembly 14 has central housing 16, a pair of pedal arms 18 coupled to and pivotally coupled to the central housing 16, and a pair of pedals 20. The central housing 16 may be positioned on stand 50 coupled to a stiff plate 52. The stiff plate 52 may be constructed of wood, plastic, metal, alloy, or the like. The stiff plate 52 may be coupled to the base panel 12. The base panel 12 may be substantially stiff absent the stiff plate 52 or the stiff plate 52 may substantially cover the base panel 12 such that the stiff plate 52 stiffens the base panel 12. The width of the stand 50 may be between 45 centimeters and 80 centimeters to provide ample support of the pedal assembly 14. The base panel 12 may have a total width between 100 centimeters and 140 centimeters.

Each pedal 20 is coupled to a distal end 22 of an associated one of the pedal arms 18 relative to the central housing 16. A pair of toe clips 24 may be provided. Each toe clip 24 is coupled to an associated one of the pedals 20. Similarly, a pair of heel straps 26 may be provided. Each heel strap 26 is coupled to an associated one of the pedals 20.

A tension mechanism 28, such as a screw mechanism adjustably engaging a bearing or axle within the central housing 16, or the like, may be coupled to the central housing 16 operationally engaging each of the pedal arms 18 wherein resistance to pivoting by the pedal arms 18 is provided by the tension mechanism 28. The tension mechanism 28 may have multiple tension settings to allow adjustable resistance. The tension mechanism 28 may provide for discreet settings or a continuously adjustable tension.

A plurality of substantially stiff support panels 30 are coupled to and extend from the base panel 12. Each support panel 30 is configured to support a portion of a person thereon while the person pedals the pedal assembly 14. Each of the support panels 30 has a padded upper surface 32 for comfort while pedaling. Each support panel 30 may be pivotally coupled to each adjacently positioned one of the support panels 30. The plurality of support panels 30 may be at least three support panels 30 coupled to and extending from the base panel 12 in series wherein the support panels 30 are configured for folding over the pedal assembly 14 and the base panel 12.

A stand assembly 36 may be coupled to an outermost support panel 38 relative to the base panel 12. The stand assembly 36 selectively holds the outermost support panel 38 in an inclined position 40 relative to an adjacently positioned one of the support panels 30. The outermost support panel 38 relative to the base panel 12 is couplable to a free edge 42 of the base panel 12 when the support panels 30 are folded over the base panel 12. The outermost support panel 38 may be coupled to the free edge 42 using hook and loop fastener, hooks, or a like conventional fastener sufficient to prevent unintended uncoupling of the outermost support panel 38 from the free edge 42. A handle 44 may be coupled to one of the support panels 30. The handle 44 is positioned on an outwardly facing top surface 46 of the support panels 30 when the support panels 30 are folded over the base panel 12 and the outermost support panel 38 is coupled to the free edge 42 of the base panel 12.

In use, the base panel 12 and support panels 30 are positioned on a flat surface such as a bed. A person wishing to exercise may lie on the support panels 30 and engage the pedals 20 with their feet. The person may read or watch television while pedaling. Upon completion of the desired amount of exercise, the support panels 30 may be folded up over the pedal assembly 14, the support panels 30 secured to the base panel 12, and the assembly lifted from the flat surface and stored until needed again.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A recumbent exercise assembly comprising:

a base panel;

a pedal assembly coupled to and extending upwardly from said base panel;

at least one support panel coupled to and extending from said base panel wherein said support panel is configured to support a person thereon while the person pedals said pedal assembly, said at least one support panel being a plurality of said support panels coupled to and extending from said base panel in series wherein said support panels are positionable to extend over and around said pedal assembly; and a stand assembly coupled to an outermost support panel relative to said base panel, said stand assembly selectively holding said outermost support panel in an inclined position relative to an adjacently positioned one of said support panels, said outermost support panel relative to said base panel being directly couplable to and secured to a free edge of said base panel when said support panels are folded over said base panel.

2. The assembly of claim 1, further comprising said pedal assembly having a central housing, a pair of pedal arms pivotally coupled to said central housing, and a pair of pedals, each said pedal being coupled to a distal end of an associated one of said pedal arms relative to said central housing.

3. The assembly of claim 2, further comprising a tension mechanism coupled to said central housing, said tension mechanism operationally engaging each of said pedal arms wherein resistance to pivoting by said pedal arms is provided by said tension mechanism.

4. The assembly of claim 1, further comprising each of said support panels having a padded upper surface.

5. The assembly of claim 2, further comprising a pair of toe clips, each toe clip being coupled to an associated one of said pedals.

6. The assembly of claim 2, further comprising a pair of heel straps, each said heel strap being coupled to an associated one of said pedals.

7. The assembly of claim 1, further comprising said plurality of said support panels being three support panels coupled to and extending from said base panel in series, each said support panel being pivotally coupled to each adjacently positioned one of said support panels.

8. The assembly of claim 1, further comprising a handle coupled to one of said support panels, said handle being positioned on an outwardly facing top surface of said support panels when said support panels are folded over said base panel and said outermost support panel is coupled to said free edge of said base panel.

9. A recumbent exercise assembly comprising:

a stiff base panel;

a pedal assembly coupled to and extending upwardly from said base panel, said pedal assembly having a central housing, a pair of pedal arms pivotally coupled to said central housing, and a pair of pedals, each said pedal being coupled to a distal end of an associated one of said pedal arms relative to said central housing;

a pair of toe clips, each toe clip being coupled to an associated one of said pedals;

a pair of heel straps, each said heel strap being coupled to an associated one of said pedals;

a tension mechanism coupled to said central housing, said tension mechanism operationally engaging each of said pedal arms wherein resistance to pivoting by said pedal arms is provided by said tension mechanism;

a plurality of substantially stiff support panels coupled to and extending from said base panel wherein each said support panel is configured to support a portion of a person thereon while the person pedals said pedal assembly, each of said support panels having a padded upper surface, each said support panel being pivotally coupled to each adjacently positioned one of said support panels, said plurality of support panels being at least three said support panels coupled to and extending from said base panel in series wherein said support panels are configured for folding over said pedal assembly and said base panel;

a stand assembly coupled to an outermost support panel relative to said base panel, said stand assembly selectively holding said outermost support panel in an inclined position relative to an adjacently positioned one of said support panels, said outermost support panel relative to said base panel being directly couplable to and secured to a free edge of said base panel when said support panels are folded over said base panel; and a handle coupled to one of said support panels, said handle being positioned on an outwardly facing top surface of said support panels when said support panels are folded over said base panel and said outermost support panel is coupled to said free edge of said base panel.

* * * * *